United States Patent [19]

Majkrzak et al.

[11] 3,999,186

[45] Dec. 21, 1976

[54] HIGH POWER, HIGH-FREQUENCY, HIGH-VOLTAGE DRIVE COUPLING FOR AN ANTENNA

[75] Inventors: Charles Peter Majkrzak, Nutley; Michael Stephen Polgar, Jr., Oceanport, both of N.J.

[73] Assignee: International Telephone and Telegraph Corporation, Nutley, N.J.

[22] Filed: Dec. 24, 1975

[21] Appl. No.: 644,286

[52] U.S. Cl. ..... 343/709; 343/885; 343/895

[51] Int. Cl.[2] ..... H01Q 1/34; H01Q 1/52

[58] Field of Search ..... 343/709, 710, 885, 895

[56] References Cited

UNITED STATES PATENTS 3,818,488 6/1974 Majkrzak ..... 343/885

*Primary Examiner*—Eli Lieberman

*Attorney, Agent, or Firm*—John T. O'Halloran; Alfred C. Hill

[57] ABSTRACT

The drive coupling for an antenna having a shorting assembly traveling along a helix to tune the antenna includes a metal rotating drive shaft extending concentrically through the shorting assembly with flutes on the drive shaft in the region of the helix. A metal shielding cylinder is disposed coaxial to and spaced from the outer surface of the drive shaft and provides an outer member of the shorting assembly. A drive bearing of dielectric material is disposed to engage the flutes and the shielding cylinder so that rotation of the drive shaft rotates the shielding cylinder to cause the shielding assembly to travel along the helix. A guide bearing of dielectric material is disposed to engage the shielding cylinder and the end of the drive shaft remote from the flutes.

29 Claims, 4 Drawing Figures

18
19
20
21
22
23
24
25
26
27
28
29
30
31
32
33
34
35
36
37
38
39
40
41
42
43
44
45
46
47
48
49
50
51
4

HIGH POWER, HIGH-FREQUENCY, HIGH-VOLTAGE DRIVE COUPLING FOR AN ANTENNA

BACKGROUND OF THE INVENTION

This invention relates to antennas and more particularly to a single multipurpose antanna structure.

Because of their higher speed, deeper submergence, and the increasing need for a more covert operation, modern submarines require communication facilities that are reliable, durable, and capable of operation with the lowest practical detectability. This is especially true for antennas.

One means towards achieving these needs is to decrease the number of required individual shipboard antennas by combining them into a single multipurpose antenna structure wherein the highest obtainable efficiencies are provided compatible with a practical size, form and ease of deployment.

A multipurpose antenna for submarine use embraces the transmission and reception of radio signals in various sectors of the frequency range from VLF (very low frequency) upwards through UHF (ultra high frequency). For practical reasons, the various antennas are stacked above one another within a hydrodynamically-shaped radome at levels dictated by the performance requirements of each individual antenna. Accordingly, the high-powered MF/HF (medium frequency/-high frequency) transmitting antenna is relegated to the bottom-most level of the stack of antennas.

In order to serve the various antennas above the MF/HF antenna, their signal wires or cables must pass around or through the high-powered MF/HF antenna. When such conductors are passed around the MF/HF antenna, they must be enclosed in a shielding conduit and be as far removed from the MF/HF antenna as is physically practical because of the tendency for electrical coupling detrimental to MF/HF antenna performance. This displacement is severly limited in a submarine antenna.

To reduce the effects of electrical coupling of the service conductors which is detrimental to MF/HF antenna performance, a remotely-controlled switch can be used to disconnect all of these conductors for optimum MF/HF performance when it is required. However, this is not completely desirable since all services above the MF/HF antenna would be rendered useless should the switch fail in an open position, and optimum MF/HF performance would not be had should the switch fail in the closed position.

Should a conduit of service conductors be passed directly through the MF/HF antenna rather than around it, it would tend to couple to the antenna to cause unacceptable performance or to absorb sufficient radiation so as to destroy the use of the conductors within it through overheating. To overcome this phenomenon, wherein a centrally-located conduit tends to couple into the radiated field of the antenna, and, in turn, itself tends to radiate because of mutually-induced current, the use of an isolator can minimize the conduit current. The isolator can be tunable circuit in concert with the frequency range of the antenna and in series with the conduit to ground so as to effect a very large impedance to the flow of conduit current.

Because of mutual coupling, a tunable MF/HF antenna of this type will demonstrate a very high voltage between parts of the radiating antenna and the conduit or, in reality, between the traveling short and its drive shaft since practical design readily permits a drive shaft to be concentric about the conduit. In high-power transmitting antennas, this voltage can be very high, for instance, in the order of 30,000 to 40,000 volts for a 2-KW (kilowatt) output, and of fairly high frequency, such as 2 to 30 megahertz. In submarine applications, practical considerations require the spacing between these elements to be quite limited. Because of these conditions, a drive and support arrangement of complex design is necessary to fulfill the electrical/mechanical requirements.

SUMMARY OF THE INVENTION

An object of the present invention is to provide a drive and support arrangement of complex design to fulfill the electrical/mechanical requirements to enable the service conductors to pass through the MF/HF antenna.

A feature of the present invention is the provision of a drive arrangement for an antenna having a shorting assembly traveling along a helix to tune the antenna comprising: a metal drive shaft extending coaxially through the shorting assembly, the drive shaft having flutes in the region of the helix; a means coupled to the drive shaft for rotation thereof; a metal shielding cylinder disposed concentric to and spaced from the outer surface of the drive shaft, the shielding cylinder providing an outer member of the shorting assembly; a drive bearing of dielectric material disposed to engage the flutes and the shielding cylinder so that rotation of the drive shaft rotates the shielding cylinder to cause the shorting assembly to travel along the helix; and a guide bearing of dielectric material disposed to engage the shielding cylinder and the end of the drive shaft remote from the flutes.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
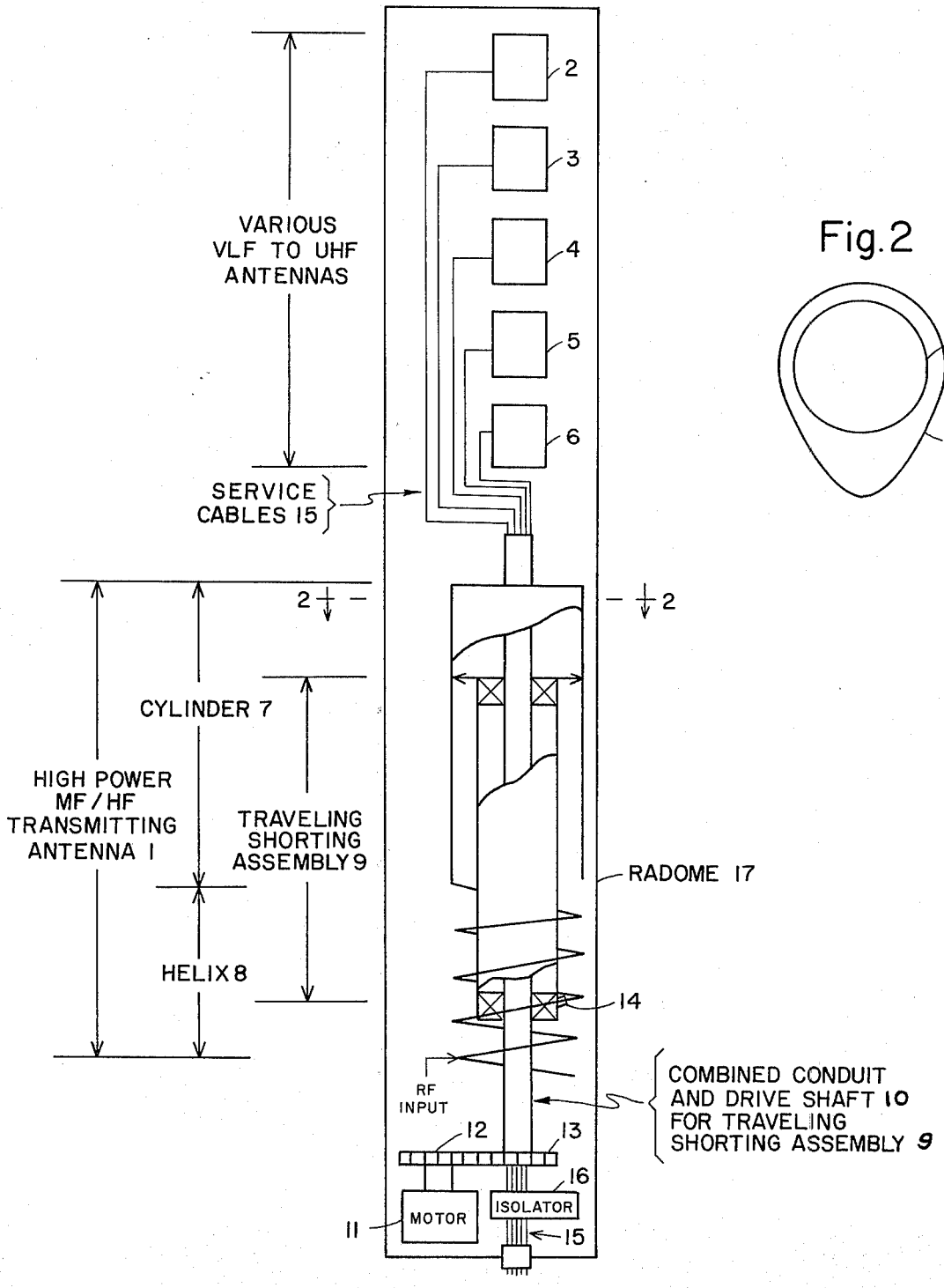
FIG. 1 is a schematic diagram of a submarine antenna having different stacked antennas with the conductor passing through the MF/HF antenna in accordance with the principles of the present invention.
Figure 2:
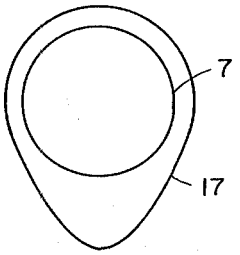
FIG. 2 is a schematic cross-sectional view taken along line 2—2 of FIG. 1.

Referring to FIGS. 1 and 2, there is illustrated therein in schematic form a multipurpose submarine antenna wherein the high power MF/HF transmitting antenna 1 is the lower most antenna of a stack of a plurality of antennas including various VLF to UHF antennas 2 – 6. Transmitting antenna 1 includes a cylinder 7 and a helix 8 which is tuned by a traveling shorting assembly 9. When the combined conduit and drive shaft 10 is rotated by motor 11 and gears 12 and 13, the shorting assembly 9 will climb the helix 8 by means of roller 14 which together with graphite brushes at each end of assembly 9 also provides the shorts for antenna 1. The service conductors or cables 15 are passed through an isolator 16 as discussed hereinabove under the heading "Background of the Invention" and, hence, through a conduit disposed coaxially of the axis of the combined conduit and drive shaft 10 and hence to the appropriate one of the antennas 2 – 6. The entire multipurpose antenna is enclosed in a radome 17 having a hydrodynamically-shaped configuration as illustrated in FIG. 2.

Figures 3, 4:
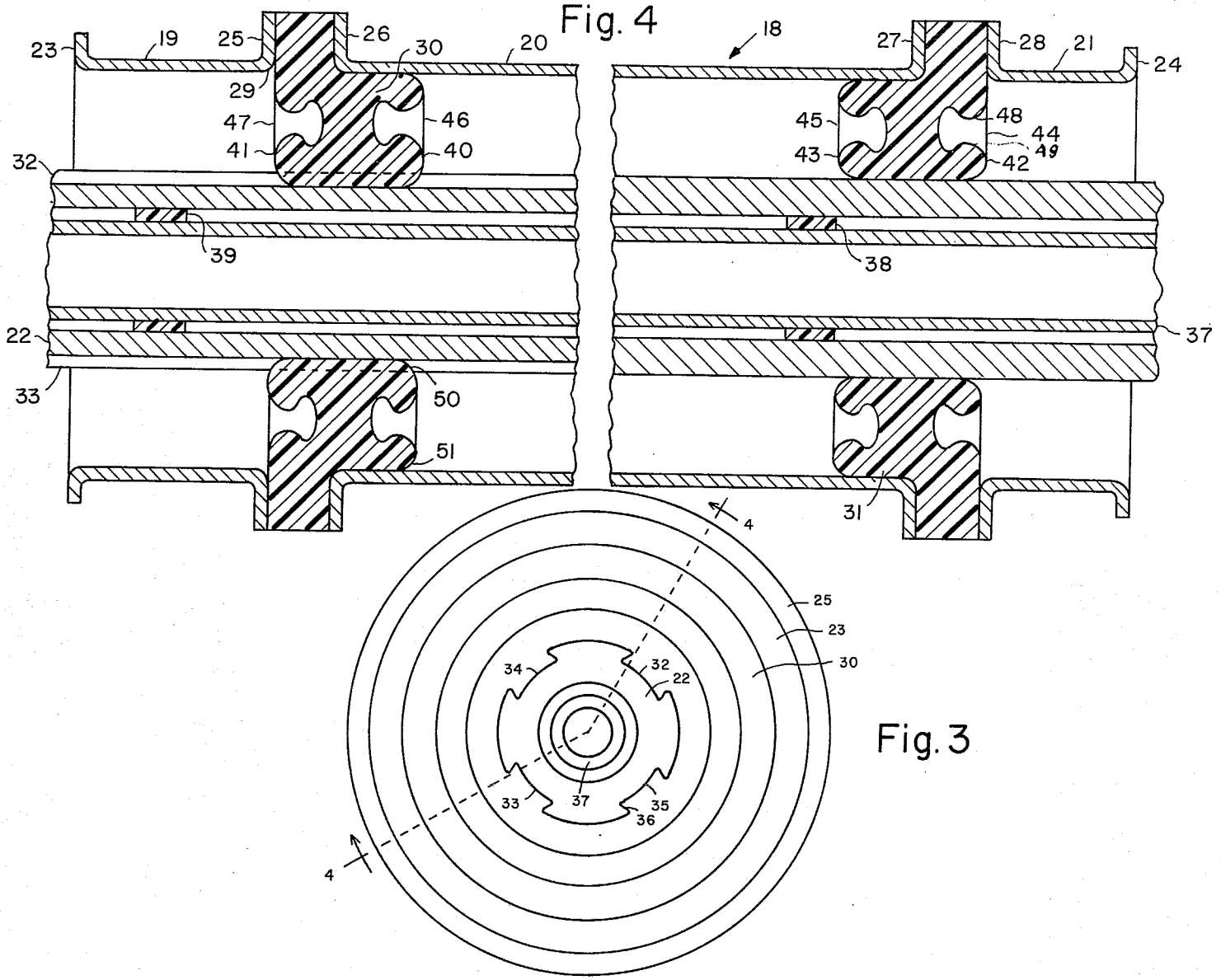
FIG. 3 is a left hand end view when viewing the drawing of the drive and support arrangement in accordance with the principles of the present invention.
FIG. 4 is a longitudinal cross-sectional view taken along line 4—4 of FIG. 3.

Referring to FIGS. 3 and 4 there is illustrated the drive and support arrangement in accordance with the principles of the present invention which enables the service conductor 15 to be passed through antenna 1 to be coupled to the appropriate ones of antennas 2 – 6. A principle feature of this assembly is a continuous cylindrical metallic inner surface provided by shielding cylinder 18 including at least three portions 19, 20 and 21. The inner surface of cylinder 18 presents a parallel-plate condition with its electrical counterpart, the concentric drive shaft 22. The ends 23 and 24 and the projections 25 – 28 of cylinder 18 are shaped to distribute the electrostatic field and provide appropriate electrical stress distributing contours, such as at point 29, to prevent steep local voltage gradients that encourage corona discharge and concentrated electrical stress in the intermediate components, such as drive bearing 30 and guide bearing 31.

Drive shaft 22 deviates from the desirable cylindrical configuration only with the appropriate number of inserted keyways or flutes 32 – 35 to drive the shorting tube assembly in rotation and yet permitting its axial displacement. These flutes or keyways 32 – 35 are also configured, such as at point 36, to discourage corona discharge and concentrated electrical stress in the drive bearing 30.

Drive bearing 30 is keyed to engage the flutes 32 – 35 so that upon rotation of drive shaft 22, drive bearing 30 will rotate cylinder 18 which is an outer cylindrical member of shorting assembly 9 (FIG. 1). As cylinder 18 rotates, the guide roller 14 (FIG. 1), which together with graphite brushes also provides the short for helix 8, travels up or down the helix according to the direction of rotation of drive shaft 22 to tune antenna 1. Thus, as cylinder 18 rotates, guide bearing 30 travels in the flutes 32 – 35 in a direction dependent upon the direction of rotation of shaft 22.

The conductors and cables for the upper antennas 2 – 6 (FIG. 1) are passed through drive shaft 22 in a conduit 37 which is maintained in a spaced relationship from the inner surface of drive shaft 22 by concentric spacers of dielectric material 38 and 39, such as Teflon or Rulon. The reason for employing conduit 37 is to prevent the conductors that pass through the drive shaft 22 from being damaged upon rotation of shaft 22, it being understood that conduit 37 is prevented from rotating and drive shaft 22 rotates about conduit 37 on the spacers 38 and 39, or any other number of spacers as may be required in a particular assembly.

The internally keyed drive bearing 30 and guide bearing 31 are made of an appropriate dielectric material having a high dielectric strength, a low dielectric constant, a low friction coefficient, a low deformation under load and a high operating temperature range. Teflon and Rulon have these characteristics and would be employed for the drive bearing 30 and guide bearing 31. Due to the characteristics outlined above, Teflon and Rulon have the physical and structural properties to adequately transfer operating loads with low friction and without significant distortion in the temperature range found in antenna 1. Further, Teflon and Rulon have electrical properties of sufficient dielectric strength to withstand the operating potentials and of a sufficiently-low loss factor to prevent serious heating in the concentrated electric field of the high frequency antenna 1.

Since the space in which drive bearing 30 and guide bearing 31 intervene between cylinder 18 and drive shaft 22 is very limited in submarine antennas for practical reasons, physical design features must be incorporated to negate the effect of a charge, known as creepage charge, from traveling along the transverse surfaces 40 and 41 of drive bearing 30 and the transverse surfaces 42 and 43 of guide bearing 31. This is accomplished by incorporating grooves 44 – 47 in each of the transverse surfaces 40 – 43 which has a predetermined cross-section and is concentric with drive shaft 22 and cylinder 18. The grooves 44 – 47 are designed to interfere with the creepage charge so that the creepage charge collects on the inner opposing surfaces 48 and 49, as illustrated with respect to groove 44, in each of grooves 44 – 47. The air gaps between surfaces 48 and 49 in series with the interrupted creepage path is of sufficient dielectric strength so as to prevent electrical breakdown between cylinder 18 and drive shaft 22 in the creepage mode.

It should also be noted that surfaces of drive bearing 30 and guide bearing 31 are shaped to provide electrical stress distributing contours between themselves and drive shaft 22 and cylinder 18, such as at points 50 and 51.

While we have described above the principles of our invention in connection with specific apparatus it is to be clearly understood that this description is made only by way of example and not as a limitation to the scope of our invention as set forth in the objects thereof and in the accompanying claims.

We claim:

1. A drive arrangement for an antenna having a shorting assembly traveling along a helix to tune said antenna comprising:

a metal drive shaft extending coaxially through said shorting assembly, said drive shaft having flutes in the region of said helix;

a means coupled to said drive shaft for rotation thereof;

a metal shielding cylinder disposed concentric to and spaced from the outer surface of said drive shaft, said shielding cylinder providing an outer member of said shorting assembly;

a drive bearing of dielectric material disposed to engage said flutes and said shielding cylinder so that rotation of said drive shaft rotates said shielding cylinder to cause said shorting assembly to travel along said helix; and a guide bearing of dielectric material disposed to engage said shielding cylinder and the end of said drive shaft remote from said flutes.

2. An arrangement according to claim 1, wherein said dielectric material of both said drive bearing and said guide bearing is a dielectric material having a high dielectric strength, a low dielectric constant, a low friction coefficient, a low deformation under load and a high operating temperature range.

3. An arrangement according to claim 2, wherein said dielectric material of both said drive bearing and said guide bearing is Rulon.

4. An arrangement according to claim 2, wherein said dielectric material of both said drive bearing and said guide bearing is Teflon.

5. An arrangement according to claim 2, wherein said shielding cylinder where it engages said drive bearing and said guide bearing is shaped to provide electrical stress distributing contours between said shielding cylinder and both said drive bearing and said guide bearing.

6. An arrangement according to claim 5, wherein said drive bearing and said guide bearing have surfaces shaped adjacent said drive shaft and said shielding cylinder to provide electrical stress distributing contours between said shielding cylinder and both said drive bearing and said guide bearing.

7. An arrangement according to claim 6, wherein a groove of predetermined cross section disposed between said shielding cylinder and said drive shaft concentric with said drive shaft is provided in both transverse surfaces of both said drive bearing and said guide bearing to prevent electric breakdown between said shielding cylinder and said drive shaft due to creepage charge traveling on said transverse surfaces.

8. An arrangement according to claim 7, wherein said antenna is the lowest antenna in vertically disposed stack of a plurality of antennas, and said drive shaft is hollow;

further including a conduit extending through said drive shaft, and conductors for each of said plurality of antennas above said lowest antenna extend through said conduit for an operation connection thereto.

9. An arrangement according to claim 8, wherein said conduit is maintained in a separated relationship with the inner surface of said drive shaft by a plurality of circular dielectric spacers concentric to and spaced along said drive shaft.

10. An arrangement according to claim 9, further including a hydrodynamically shaped radome enclosing said arrangement for utilization on a submarine.

11. An arrangement according to claim 1, wherein said shielding cylinder where it engages said drive bearing and said guide bearing is shaped to provide electrical stress distributing contours between said shielding cylinder and both said drive bearing and said guide bearing.

12. An arrangement according to claim 11, wherein said drive bearing and said guide bearing have surfaces shaped adjacent said drive shaft and said shielding cylinder to provide electrical stress distributing contours between said shielding cylinder and both said drive bearing and said guide bearing.

13. An arrangement according to claim 12, wherein a groove of predetermined cross section disposed between said shielding cylinder and said drive shaft concentric with said drive shaft is provided in both transverse surfaces of both said drive bearing and said guide bearing to prevent electrical breakdown between said shielding cylinder and said drive shaft due to creepage charge traveling on said transverse surfaces.

14. An arrangement according to claim 13, wherein said antenna is the lowest antenna in vertically disposed stack of a plurality of antennas, and said drive shaft is hollow;

further including a conduit extending through said drive shaft, and conductors for each of said plurality of antennas above said lowest antenna extend through said conduit for an operation connection thereto.

15. An arrangement according to claim 14, wherein said conduit is maintained in a separated relationship with the inner surface of said drive shaft by a plurality of circular dielectric spacers concentric to and spaced along said drive shaft.

16. An arrangement according to claim 15, further including a hydrodynamically shaped radome enclosing said arrangement for utilization on a submarine.

17. An arrangement according to claim 1, wherein said drive bearing and said guide bearing have surfaces shaped adjacent said drive shaft and said shielding cylinder to provide electrical stress distributing contours between said shielding cylinder and both said drive bearing and said guide bearing.

18. An arrangement according to claim 17, wherein a groove of predetermined cross section disposed between said shielding cylinder and said drive shaft concentric with said drive shaft is provided in both transverse surfaces of both said drive bearing and said guide bearing to prevent electric breakdown between said shielding cylinder and said drive shaft due to creepage charge traveling on said transverse surfaces.

19. An arrangement according to claim 18, wherein said antenna is the lowest antenna in vertically disposed stack of a plurality of antennas, and said drive shaft is hollow;

further including a conduit extending through said drive shaft, and conductors for each of said plurality of antennas above said lowest antenna extend through said conduit for an operation connection thereto.

20. An arrangement according to claim 19, wherein said conduit is maintained to a separated relationship with the inner surface of said drive shaft by a plurality of circular dielectric spacers concentric to and spaced along said drive shaft.

21. An arrangement according to claim 20, further including a hydrodynamically shaped radome enclosing said arrangement for utilization on a submarine.

22. An arrangement according to claim 1, wherein a groove of predetermined cross section disposed between said shielding cylinder and said drive shaft concentric with said drive shaft is provided in both transverse surfaces of both said drive bearing and said guide bearing to prevent electric breakdown between said shielding cylinder and said drive shaft due to creepage charge traveling on said transverse surfaces.

23. An arrangement according to claim 22, wherein said antenna is the lowest antenna in vertically disposed stack of a plurality of antennas, and said drive shaft is hollow;

further including a conduit extending through said drive shaft, and conductors for each of said plurality of antennas above said lowest antenna extend through said conduit for an operation connection thereto.

24. An arrangement according to claim 23, wherein said conduit is maintained in a separated relationship with the inner surface of said drive shaft by a plurality of circular dielectric spacers concentric to and spaced along said drive shaft.

25. An arrangement according to claim 24, further including a hydrodynamically shaped radome enclosing said arrangement for utilization on a submarine.

26. An arrangement according to claim 1, wherein said antenna is the lowest antenna in vertically disposed stack of a plurality of antennas, and said drive shaft is hollow; further including a conduit extending through said drive shaft, and conductors for each of said plurality of antennas above said lowest antenna extend through said conduit for an operation connection thereto.

27. An arrangement according to claim 26, wherein said conduit is maintained in a separated relationship with the inner surface of said drive shaft by a plurality of circular dielectric spacers concentric to and spaced along said drive shaft.

28. An arrangement according to claim 27, further including a hydrodynamically shaped radome enclosing said arrangement for utilization on a submarine.

29. An arrangement according to claim 1, further including a hydrodynamically shaped radome enclosing said arrangement for utilization on a submarine.

* * * * *